US005805405A

United States Patent [19]

Benkaroun et al.

[11] Patent Number: 5,805,405

[45] Date of Patent: Sep. 8, 1998

[54] POWER SUPPLY CIRCUIT OF AN EXCITATION COIL OF AN ELECTROMAGNET

[75] Inventors: Karim Benkaroun, Sartrouville; Manuel Lima, Paris; Alain Gousset, Nanterre, all of France

[73] Assignee: Schneider Electric SA, Boulogne Billancourt, France

[21] Appl. No.: 729,284

[22] Filed: Oct. 10, 1996

[30] Foreign Application Priority Data

Oct. 12, 1995 [FR] France ..... 95 12077

[51] Int. Cl.[6] ..... H01H 47/04

[52] U.S. Cl. ..... 361/194; 361/197; 361/154

[58] Field of Search ..... 361/152, 154, 361/194, 195, 197, 210, 196, 198, 155

[56] References Cited

U.S. PATENT DOCUMENTS

| | | | |
|---|---|---|---|
| 3,689,808 | 9/1972 | Stampfli | 317/155 |
| 3,737,736 | 6/1973 | Stampfli | 361/154 |
| 3,786,314 | 1/1974 | Misch | 361/154 |
| 4,032,823 | 6/1977 | Arvisenet et al. | 361/194 |
| 4,114,184 | 9/1978 | Stampfli | 361/154 |
| 4,227,231 | 10/1980 | Hansen et al. | 361/154 |
| 4,873,607 | 10/1989 | Yamamoto | 361/210 |
| 4,998,177 | 3/1991 | Takizawa et al. | 361/154 |

FOREIGN PATENT DOCUMENTS

| | | |
|---|---|---|
| 2 290 009 | 5/1976 | France . |
| 2 128 651 | 11/1972 | Germany . |
| 26 39 233 | 3/1977 | Germany . |

OTHER PUBLICATIONS

Patent Abstracts of Japan, vol. 7, No. 106 (M–213), May 10, 1983, JP 58–28074, February 18, 1983.

*Primary Examiner*—Peter S. Wong
*Assistant Examiner*—Derek J. Jardieu
*Attorney, Agent, or Firm*—Oblon, Spivak, McClelland, Maier & Neustadt, P.C.

[57] ABSTRACT

A power supply circuit, using direct current or rectified alternating current sources having output and return supply lines (a, b), for a coil of an electromagnet having at least one principal winding (B1) and a secondary winding (B2). The power supply circuit includes a first semiconductor element (T2) having a gate and a source drain path and capable of providing or blocking a supply of current to the secondary winding (B2), the source drain path connected between the secondary winding (B2) and the return supply line (b); and a switching means (10) connected between the primary winding (B1) and the gate of the first semiconductor element (T2). The switching means (10) includes a second semiconductor element (T1) having a gate and a source drain path and capable of keeping the first semiconductor element (T2) from conducting when a voltage between the gate of the second semiconductor element (T1) and the return supply line (b) reaches a threshold voltage (Vs) greater than a value (V1) corresponding to a start of a closing of the electromagnet, the source drain path of the second semiconductor element (T1) connected between the gate of the first semiconductor element (T2) and the return supply line (b), and an adaptation circuit connected between the primary winding (B1) and the gate of the second semiconductor element (T1).

20 Claims, 3 Drawing Sheets

POWER SUPPLY CIRCUIT OF AN EXCITATION COIL OF AN ELECTROMAGNET

This invention relates to a power supply circuit, using direct current or rectified alternating current, for an excitation coil of an electromagnet having at least one principal winding and one secondary winding.

DISCUSSION OF BACKGROUND

It is known that a double winding coil may be used for an electromagnet in order to reduce the overheating of the coil and the consumption of current required for its supply. The coil includes for this purpose a call winding and a holding winding.

When the windings are arranged in parallel, they are both first supplied with a strong call current in order to cause the initial movement of the mobile magnetic circuit of the electromagnet, then the holding winding alone remains supplied with a weaker current so as to maintain the mobile magnetic circuit in attracted position, the supply of the call winding being halted by switching.

The switching of the supply of one of these windings by electronic means after a chosen time delay is known, for example, from Patent DE 2128651. However, it is difficult to control the length of time chosen for this delay. Switching may in fact take place before the closing of the magnetic circuits, in which case the electromagnet will close but will be unable to remain in attracted position, or it may occur too late thereby causing the coil to overheat and leading to a slowdown in the operating output of the electromagnet.

SUMMARY OF THE INVENTION

Accordingly, the invention aims to provide an electronic circuit ensuring the switching of the power supply of one of the two windings of the coil only when, after closing of the electromagnet, the current of the coil is very close to reaching the holding current which is sufficient to maintain the mobile magnetic circuit in attracted position.

According to the invention, the power supply circuit includes a switching means of a first controlled conductivity semiconductor element capable of providing or blocking the supply of the secondary winding, the switching means being arranged between the principal winding and the gate of the first semiconductor element and includes a second semiconductor element and an adaption circuit. The switching means are designed to carry out the switching of the first semiconductor element when the voltage between the gate and the output of the second semiconductor element reaches a threshold voltage greater than the value corresponding to the start of the closing of the electromagnet.

According to another aspect of the invention, the voltage adaptation circuit which is connected to the principal winding and to the gate of the second semiconductor element, the output of the second semiconductor element being connected to the gate of the first semiconductor element in order to block the first semiconductor element when the voltage between the gate and the output of the second semiconductor element reaches the threshold value.

The adaptation circuit advantageously includes an RC filter made up of a resistive element and a capacitor connected in parallel, the gate of the second semiconductor element being connected to an input of the adaptation circuit.

The resistive element is preferentially made up of a divider bridge equipped with two series resistors, one of the resistors being connected to the principal winding and the other resistor being placed in parallel with the capacitor and connected to the supply return line of the coil.

Thus, the arrangement and constitution of the switching means make it possible to carry out with confidence the switching of the first semiconductor element when the current is near to reaching the holding value after total closing of the electromagnet.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
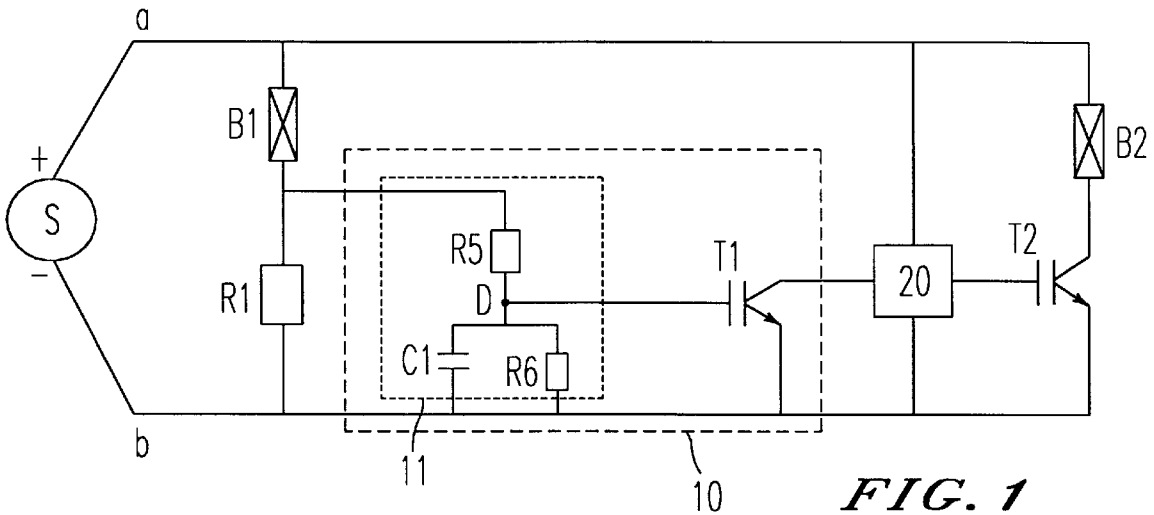
FIG. 1 represents the power supply circuit according to the invention.

Referring now to the drawings, wherein like reference numerals designate identical or corresponding parts throughout the several views, and more particularly to FIG. 1 thereof, which represents the power supply circuit of an excitation coil of an electromagnet according to the invention.

The electromagnet, not represented here, comprises the excitation coil, a fixed magnetic circuit and a mobile magnetic circuit designed to be attracted by the fixed magnetic circuit when the coil is supplied in current. The coil of the electromagnet is fitted with two windings, a principal winding B1 and a secondary winding B2.

The windings B1 and B2 are placed in parallel between two supply lines, an output line a and a return line b, linked to the respective positive and negative poles of a source S of current supply. This circuit may function from a source of direct current (FIGS. 1 to 3 ) or of rectified alternating current (FIG. 4).

The principal winding B1 and the secondary winding B2 are capable of activating the movement of the mobile magnetic circuit. The principal winding B1 is alone continuously supplied so as to maintain the mobile magnetic circuit in attracted position once the electromagnet is closed.

The principal winding B1 is connected in series with a resistor R1 between the supply lines a and b.

The supply of the secondary winding B2 is controlled by a controlled conductivity semiconductor element T2, for example of transistor type.

The transistor T2, of bipolar or other type, is connected to a threshold voltage circuit 20 which delivers the threshold voltage necessary to the conductivity of T2 as soon as the circuit is switched on.

Figure 2:
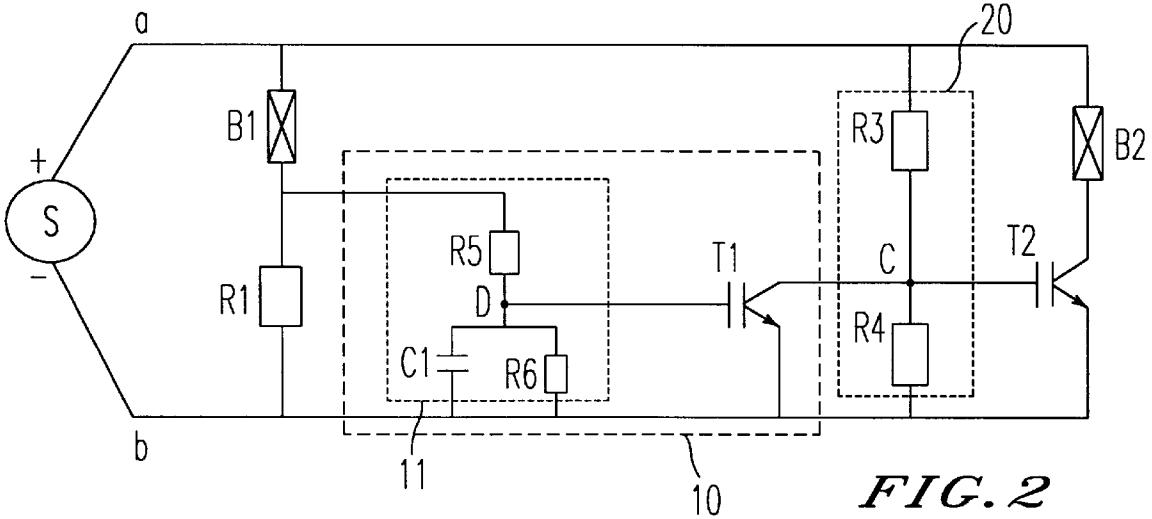
FIGS. 2 and 3 represent the circuit of FIG. 1 supplied with direct current according to two embodiments.

In a first embodiment of the circuit supplied with direct current, as illustrated in FIG. 2, the circuit 20 may consist of two resistors R3 and R4 connected in series between the lines a and b, the gate of the transistor T2 being linked to the point of connection C of the two resistors.

Figure 3:
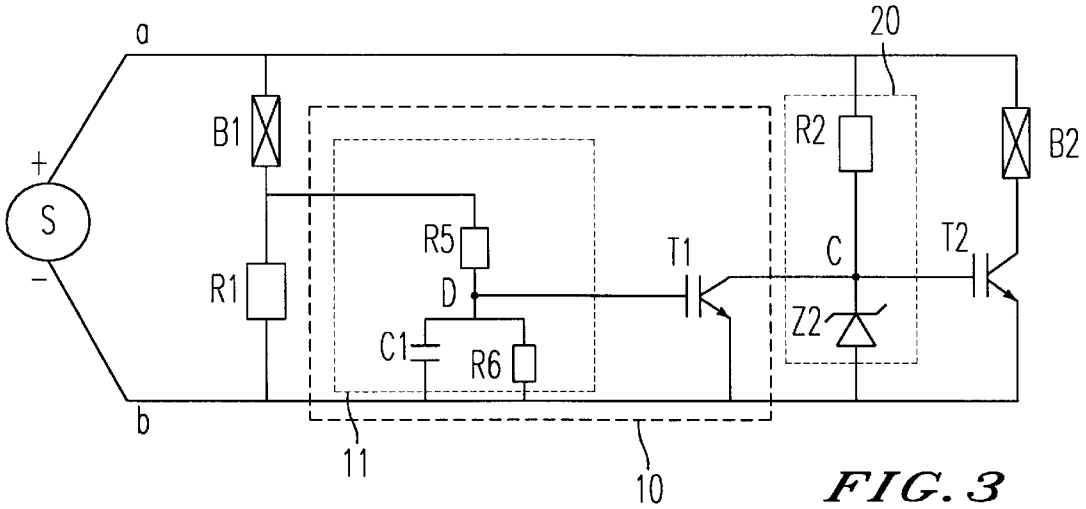
Figure 4:
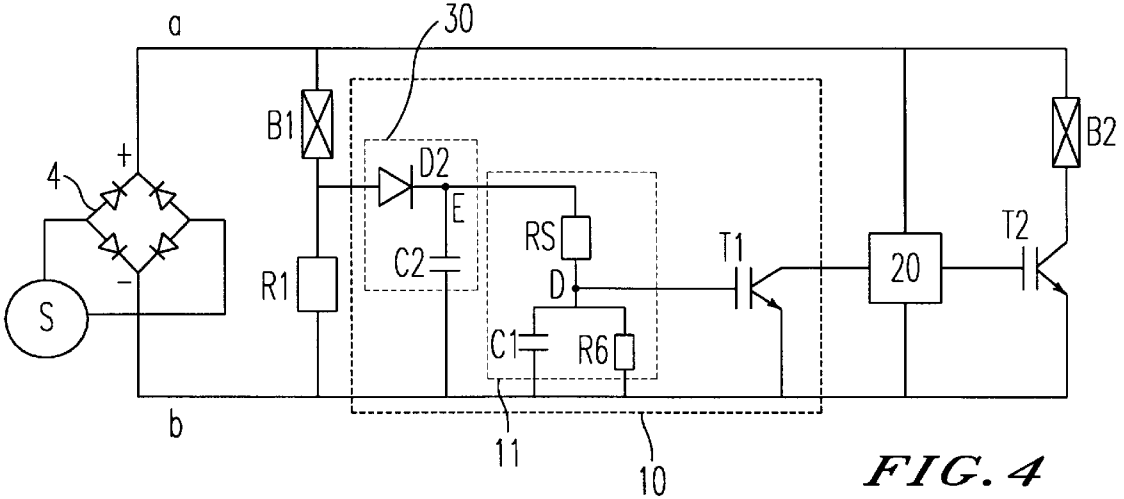
FIG. 4 represents the circuit of FIG. 1 supplied with rectified alternating current.

In a second embodiment of the circuit supplied with direct current, as illustrated in FIG. 3, the circuit 20 may consist of a resistor R2 and a Zener diode Z2 connected in series between the lines a and b, the gate of the transistor T2 being linked to the point of connection C of the resistor R2 and the zener diode Z2.

The transistor T2 is designed to be blocked after the closing of the magnetic circuits of the electromagnet in order to cut off the power supply of the secondary winding B2. The transistor is blocked through switching means 10 arranged between its gate and the principal winding B1.

The switching means 10 includes a voltage adaptation circuit 11 and a controlled conductivity semiconductor element T1 of transistor type.

The voltage adaptation circuit 11 includes a resistor R5 connected to the principal winding B1 and placed in series with an RC-type filter consisting of a resistor R6 and a capacitor C1 connected in parallel and linked to the return line b. The voltage adaptation circuit 11 constitutes a voltage integrator.

The transistor T1, of bipolar or other type, presents an input linked to the gate of the transistor T2, an output linked to the return line b, and a gate linked to the point of connection D between the resistor R5 and the resistor R6 of the adaptation circuit 11.

The diagram of FIG. 4 represents the power supply circuit, according to the present invention, supplied from a source of double half-wave rectified alternating current.

For this embodiment, a rectifier bridge is placed between the alternating current supply source S and the power supply lines a and b of the circuit so as to supply the power supply circuit with double half-wave rectified alternating current, each half-wave being made up of rectified sinusoids. Moreover, a smoothing appliance 30 is optionally added in order to attenuate the form of the rectified sinusoids. The smoothing applicance 30 includes a diode D2 and a capacitor C2 placed in series between the principal winding B1 and the return line b, the resistor R5 of the circuit 11 being linked to a middle point E connecting the diode D2 and the capacitor C2.

The operation of the power supply circuit, according to the present invention, will now be described.

As soon as a voltage is applied between the lines a and b, the current is established through, firstly, the winding B1 and the resistor R1, and secondly the threshold voltage organ. The potential at the gate of the transistor T2 is now instantaneously sufficient to allow the transistor T2 to transmit the current, thereby activating the winding B2.

Figure 5A:
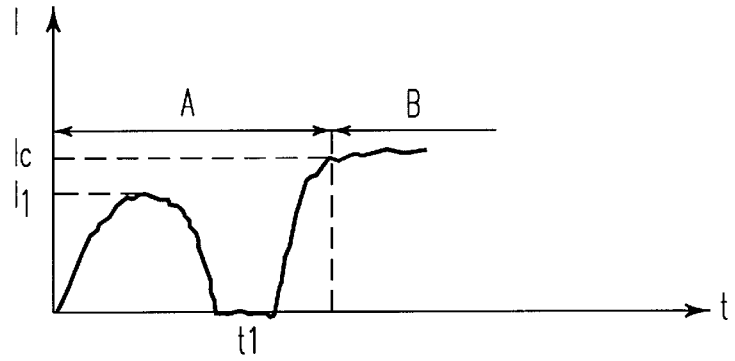
FIG. 5*a* and 5*b* are graphs, illustrating in a manner known in the art, the intensity variation respectively in the principal winding and the secondary winding, as a function of time.
Figure 5B:
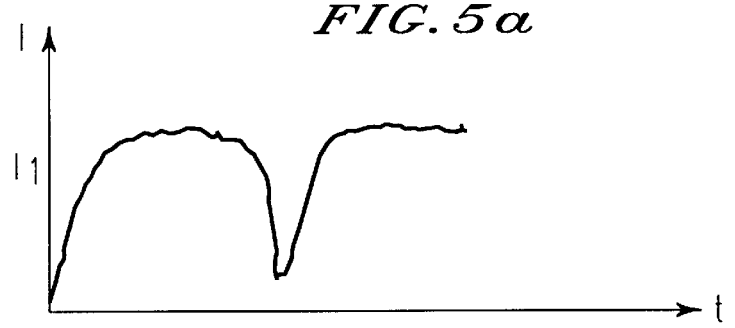

FIGS. 5*a* and 5*b* represent the current circulating in the principal winding B1 and in the secondary winding B2 respectively. The current circulating in the secondary winding B2 is the same as in the principal winding B1, apart from the fact that the current does not take negative values. Thus, to study the image of the current in the coil, it suffices to study the current in the principal winding.

With rectified alternating current, the current is the same but the curve is made up of sinusoids. As a result, the constitution of the adaptation circuit 11 may remain unchanged in relation to that of the direct current circuit.

As is illustrated in FIG. 5*a*, a distinction is made between two phases, the call phase A and the holding phase B; the transition between the two phases corresponds to the moment when the current is stabilized at a holding value after the closing of the electromagnet.

During the call phase A, the current increases through the two windings up to a value 11, starting from which the mobile magnetic circuit moves towards the fixed magnetic circuit, causing a simultaneous reduction of the current until the closing of the electromagnetic corresponding to the time t1 in the FIG. 5*a*; these stages are characteristic of the first surge 01 of the current. At the closing of the electromagnet the current increases again along a curve of exponential type which corresponds to the second surge 02 of the current to reach the holding value 1*c* corresponding to the start of the holding phase B. The power supply of the secondary winding B2 may now be cut off using the switching means 10, the adaptation circuit 11 authorizing the permutation as the electromagnet is now closed.

Figure 6:
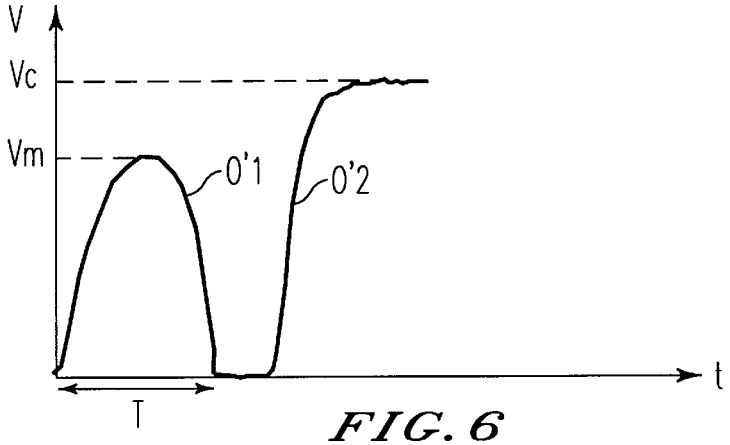
FIG. 6 is a graph illustrating the voltage variation corresponding to the image of the intensity variation of FIG. 5*a*.

FIG. 6 illustrates the voltage at the terminals of the resistor R1 corresponding to the current in the winding B1 illustrated in FIG. 5*a* since this voltage is representative of the current in the winding B1. It is this voltage which is treated by the adaptation circuit 11. An image of the current circulating in the coil is therefore required; this image is obtained by means of measurement across resistor R1 or a Zener diode.

Figure 7:
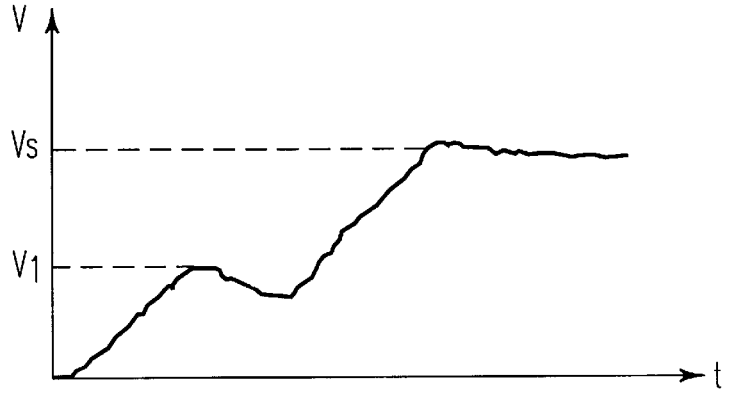
FIG. 7 is a graph illustrating the voltage variation at the terminals of the RC circuit provided as a the voltage adaptation circuit in function of time.

FIG. 7 illustrates the voltage at the terminals of the RC circuit of the adaptation circuit 11, that is to say between the gate and the output of the transistor T1.

As is shown by FIGS. 6 and 7, during the rise of the voltage at the terminals of R1 to a maximum value Vm of the first voltage surge 0'1, the capacitor C1 is loaded up to a voltage value V1, these voltage values Vm and V1 corresponding to the start of the movement of the mobile magnetic circuit.

The capacitor C1 is loaded without reaching its maximum capacity so that the voltage remains less than a threshold voltage Vs which corresponds to the voltage required to activate the conductivity of the transistor T1. For the value V1 of the voltage at the terminals of the RC circuit, and thus of the voltage between the gate and the output of the transistor T1, to remain less than the threshold value Vs as long as the electromagnet is not closed, steps are taken to ensure that the value Vm of the first voltage surge 0'1 at the terminals of R1 is less than the holding voltage Vc of the second voltage surge 0'2 corresponding to the holding current 1*c* sufficient to maintain the electromagnet closed, which is carried out through the voltage adaptation circuit 11. The two resistors R5 and R6 and the capacitor C1 constitute an integrator which processes the voltage signal delivered at the terminals of the resistor R1 in order to adapt, from this signal, the time required to reach the activation threshold Vs of the transistor T1.

Then the capacitor C1 discharges during the voltage drop at the terminals of R1 which corresponds to the movement of the mobile magnetic circuit.

When the electromagnet is closed, the voltage at the terminals of R1 rises once more, thereby causing once again the loading of the capacitor C1. When the capacitor reaches its maximum current-carrying capacity, the voltage at the terminals of R1 has reached the holding value Vc and the voltage at the terminals of RC has reached the threshold value Vs, causing the conductivity activation of the transistor T1 and its conductivity. The potential at the gate of the transistor T2 then collapses thereby causing its blockage; the secondary winding B2 is therefore no longer supplied and the principal winding B1 alone continues to be supplied at a holding value of the current. This holding value must remain sufficient during the closing of the electromagnet so that the capacitor remains loaded at its maximum current-carrying capacity so as not to cause the voltage to drop between the command and the output of the transistor T1, as this would block the conductivity of the transistor T1 and would supply anew the winding B2.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A power supply circuit, using direct current or rectified alternating current sources having output and return supply lines, for a coil of an electromagnet having at least one primary winding and a secondary winding, comprising:

a first semiconductor element having a gate and a source drain path and capable of providing or blocking a supply of current to the secondary winding, the source drain path connected between the secondary winding and the return supply line; and a switching means connected between the primary winding and the gate of the first semiconductor element, including, a second semiconductor element having a gate and a source drain path and capable of keeping the first semiconductor element from conducting when a voltage between the gate of the second semiconductor element and the return supply line reaches a threshold voltage greater than a value corresponding to a start of a closing of the electromagnet, the source drain path of the second semiconductor element connected between the gate of the first semiconductor element and the return supply line, and an adaptation circuit connected between the primary winding and the gate of the second semiconductor element, said adaptation circuit estimating a voltage representative of an image of a current circulating in the primary winding and integrating the circulating current to adapt a time required to reach an activation threshold of the second semiconductor element.

2. The power supply circuit according to claim 1, wherein the first and second semiconductor elements are transistors.

3. The power supply circuit according to claim 1, wherein the principal winding and the secondary winding are connected between the output and return supply lines.

4. The power supply circuit according to claim 1, further comprising a means for measuring an image of current circulating in the principal winding, the measuring means connected in series between the principle winding and the return supply line and with the adaptation circuit.

5. The power supply circuit according to claim 1, wherein the adaptation circuit comprises an RC filter having first and second resistors connected in series between the principal winding and the return supply line, and a capacitor connected in parallel across the second resistor.

6. The power supply circuit according to claim 5, wherein the first and second semiconductor elements are transistors.

7. The power supply circuit according to claim 5, wherein the principal winding and the secondary winding are arranged between the output and return supply lines.

8. The power supply circuit according to claim 5, further comprising a means for measuring an image of current circulating in the principal winding, the measuring means connected in series between the principle winding and the return supply line and with the adaptation circuit.

9. The power supply circuit according to claim 5, wherein the gate of the second semiconductor element is connected between the first and second resistors.

10. The power supply circuit according to claim 9, wherein the first and second semiconductor elements are transistors.

11. The power supply circuit according to claim 9, wherein the principal winding and the secondary winding are connected between the output and return supply lines.

12. The power supply circuit according to claim 9, further comprising a means for measuring an image of current circulating in the principal winding, the measuring means connected in series between the principal winding and the return supply line and with the adaptation circuit.

13. The power supply circuit according to claim 9, further comprising:

a threshold circuit including third resistor and a diode connected in series between the output and return supply lines, the gate of the first semiconductor element connected between the third resistor and the diode.

14. The power supply circuit according to claim 5, wherein the first and second semiconductor elements are transistors.

15. The power supply circuit according to claim 14, wherein the principal winding and the secondary winding are connected in parallel between the output and return supply lines.

16. The power supply circuit according to claim 15, further comprising a means for measuring an image of current circulating in the principal winding, the measuring means connected in series between the principle winding and the return supply line and in parallel with the adaptation circuit.

17. The power supply circuit according to claim 9, further comprising:

a threshold circuit including third and fourth resistors connected in series between the output and return supply lines, the gate of the first semiconductor element connected between the third and fourth resistors.

18. The power supply circuit according to claim 17, wherein the first and second semiconductor elements are transistors.

19. The power supply circuit according to claim 18, wherein the principal winding and the secondary winding are connected between the output and return supply lines.

20. The power supply circuit according to claim 19, further comprising a means for measuring an image of current circulating in the principal winding, the measuring means connected in series between the principal winding and the return supply line and with the adaptation circuit.

* * * * *